US007735690B2

(12) United States Patent
Bloc et al.

(10) Patent No.: US 7,735,690 B2
(45) Date of Patent: Jun. 15, 2010

(54) COVERING DEVICE FOR A LIQUID PRODUCT DISPENSING MEMBER

(75) Inventors: Richard Bloc, Derchigny-Graincourt (FR); Herve Lompech, Bouttencourt (FR)

(73) Assignee: Rexam Dispensing Systems S.A.S. (FR)

( * ) Notice: Subject to any disclaimer, the term of this patent is extended or adjusted under 35 U.S.C. 154(b) by 496 days.

(21) Appl. No.: 11/303,212

(22) Filed: Dec. 16, 2005

(65) Prior Publication Data

US 2006/0157510 A1 Jul. 20, 2006

Related U.S. Application Data

(63) Continuation of application No. PCT/FR2005/000638, filed on Mar. 16, 2005.

(51) Int. Cl.
*B67D 7/06* (2010.01)

(52) U.S. Cl. ..... 222/182; 222/173; 222/320; 222/321.1

(58) Field of Classification Search ..... 222/321.1, 222/153, 182, 402.13, 173, 513, 320, 183, 222/402.1, 321.2, 321.7, 321.9, 402.2; 239/288, 239/288.5, 288.3
See application file for complete search history.

(56) References Cited

U.S. PATENT DOCUMENTS

| | | | | | |
|---|---|---|---|---|---|
| 2,998,165 | A * | 8/1961 | De Elorza | 222/182 |
| 3,006,510 | A * | 10/1961 | Sagarin | 222/402.13 |
| 3,227,321 | A * | 1/1966 | Sagarin | 222/402.13 |
| 3,286,885 | A * | 11/1966 | Huling | 222/182 |
| 3,401,843 | A * | 9/1968 | Ahrens et al. | 222/182 |
| 3,429,483 | A * | 2/1969 | Micallef | 222/153.11 |
| 3,729,119 | A * | 4/1973 | Sette et al. | 222/153.11 |
| 3,760,988 | A * | 9/1973 | Ostrowsky | 222/153.11 |
| 3,934,761 | A * | 1/1976 | Gentreau | 222/183 |
| 5,114,051 | A * | 5/1992 | Simon | 222/192 |
| 5,139,180 | A * | 8/1992 | Lucas | 222/402.13 |
| 6,003,739 | A | 12/1999 | Bartlett et al. | 222/402.1 |
| 6,588,629 | B1 | 7/2003 | De Pous | 222/182 |
| 7,121,434 | B1 * | 10/2006 | Caruso | 222/402.13 |
| 2003/0127468 | A1 | 7/2003 | Loghman-Adham et al. | 222/153.14 |
| 2007/0007309 | A1 * | 1/2007 | Eberhardt | 222/402.13 |

FOREIGN PATENT DOCUMENTS

| | | | |
|---|---|---|---|
| DE | 29610372 | U1 | 10/1996 |
| FR | 1556668 | * | 2/1969 |

OTHER PUBLICATIONS

International Search Report, Jun. 29, 2005, 2 pages.

* cited by examiner

*Primary Examiner*—Kevin P Shaver
*Assistant Examiner*—Robert K Nichols, II
(74) *Attorney, Agent, or Firm*—St. Onge Steward Johnston & Reens LLC

(57) ABSTRACT

A device for encasing a system for dispensing a liquid product, provided mainly with an evacuation conduit, the downstream end of which opens to the outside, characterized in that it includes, on the one hand, a compartment respectively delimited by a back wall and a front wall with an outlet orifice in it and, on the other hand, at least one elastic return element supported by the said system on the side opposite the downstream end that can retract such as to allow the said system to be inserted in the said compartment and can then rest against the back wall to as to insert and maintain the end of the said conduit in the outlet orifice.

16 Claims, 2 Drawing Sheets

COVERING DEVICE FOR A LIQUID PRODUCT DISPENSING MEMBER

CROSS-REFERENCE TO RELATED APPLICATIONS

This application is a continuation of International Patent Application No. PCT/FR2005/000638 filed on Mar. 16, 2005, which designates the United States and claims priority of French Patent Application No. 0402779 filed on Mar. 17, 2004.

FIELD OF THE INVENTION

The present invention relates to a device for encasing a system for dispensing a liquid product.

BACKGROUND OF THE INVENTION

Dispensing systems are generally small, complex technical assemblies that can be mounted on several types of packaging. These include, for example, spray nozzles, aerosol valves, drop dispensers, etc.

It is often necessary, for technical and/or aesthetical reasons, to conceal these systems or to integrate them in a packaging without affecting their main product-dispensing function.

When the packaging uses an operating device such as a tappet-button, the encasing and assembly of the dispensing system with the button is a delicate operation that must, however, be carried out easily and quickly in order for it to be automated.

Furthermore, if the tappet-button has elements that are intended to cooperate functionally with the dispensing system and, mainly, with the downstream end of the evacuation conduit, their relative positioning must be carried out in a precise and stable manner.

The aim of the present invention is to solve these technical problems in a satisfying manner.

SUMMARY OF THE INVENTION

This aim is achieved, according to the invention, by means of a device that comprises, on the one hand, a compartment that is delimited respectively by a back wall and a front wall pierced by an outlet orifice and, on the other hand, at least one elastic return element that rests on the said system on the side opposite to the downstream end and which is retractable so as to allow the insertion of the said system in the said compartment and then to lean on the back wall so as to insert and maintain the downstream end of the said conduit in the said outlet orifice.

According to an advantageous characteristic, the device comprises, among others, a stopping element made up of a plate that supports the said conduit, the profile of which is adapted to the profile of the front wall against which the said plate rests.

The downstream end of the said conduit preferably projects from the outside of the case.

According to another characteristic, the said elastic return element consists of at least one flexible tab that has a guiding bottom face, which is tilted in its relaxed position in relation to the cross-section of the downstream end of the said conduit and is designed to come into sliding contact with the back wall of the case when the dispensing system is inserted.

According to a specific alternative, the said tab has a flat end that is designed to come into stable resting contact against the back face of the case when the downstream end of the conduit is lined up with the outlet conduit.

According to yet another characteristic, the said compartment comprises a bottom that connects the back and front walls and which provides a stop for the system when the downstream end of the conduit is inserted in the outlet orifice.

According to an alternative, the said tab is connected to the said system by means of a fillet forming a hinge.

According to yet another advantageous characteristic, the said compartment comprises a bottom that connects the back and front walls.

According to a specific variant, the said system rests against the bottom when the downstream end of the conduit is lined up with the outlet orifice.

According to a further alternative, the said compartment is arranged inside an external case forming a tappet-button.

The device preferably comprises two elastic return elements disposed on either side of the said conduit.

The device of the invention makes it possible to assure the automatic assembly of a dispensing system with an external packaging case.

The guiding means of the system make it possible to guarantee a precise positioning of the pieces with relatively low distortion stress levels during the assembly.

This assembly is carried out, furthermore, in a reversible manner and it is therefore possible to separate the parts after they have been assembled.

BRIEF DESCRIPTION OF THE DRAWINGS

The invention will be understood better from reading the following description, made in reference to the figures, in which.

DETAILED DESCRIPTION OF THE INVENTION

Figure 1:
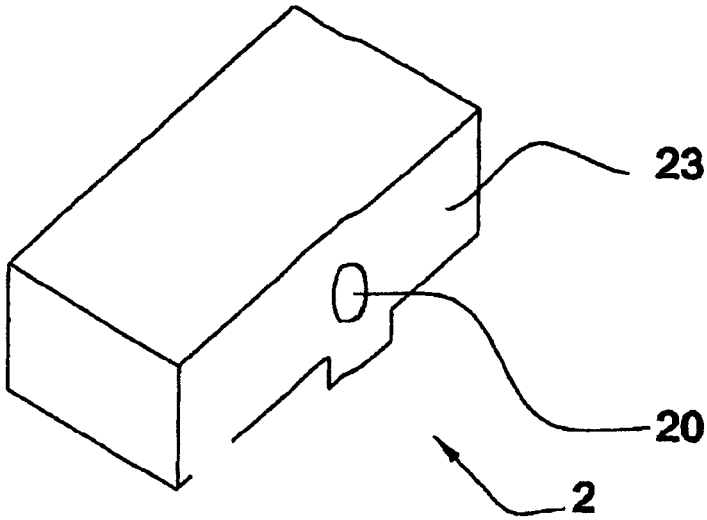
FIG. 1 shows an exploded perspective view of an embodiment of the device according to the invention, before assembly.

The device shown in the figures is intended for encasing a system 1 for dispensing a liquid product from a packaging (not shown).

This system 1 comprises mainly an evacuation conduit 10, the upstream end 10*a* of which can be connected to means for collecting the product (not shown) such as a pump, and the downstream end 10*b* of which opens to the outside, for example by means of a spray nozzle.

In the embodiment of the invention shown, the upstream 10*a* and downstream 10*b* ends are supported by perpendicular conduit sections.

The device of the invention comprises a compartment 22, in this case arranged inside an outer case 2, and delimited respectively by a back wall 21 and a front wall 23 containing an outlet orifice 20.

If necessary, the case 2 can form, wholly or partially, a tappet-button.

The device of the invention also comprises at least one and, in the embodiment of the invention shown, preferably two elastic return elements 11 supported by the system 1, on the side opposite to the downstream end 10*b* and disposed symmetrically on either side of the conduit 10.

Figure 3B:
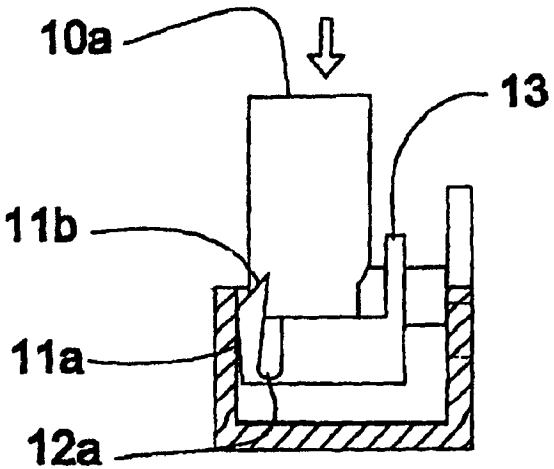
FIGS. 3A, 3B and 3C show section views of the various steps in the assembly of the embodiment of the invention shown in FIGS. 1 and 2.
Figure 3C:
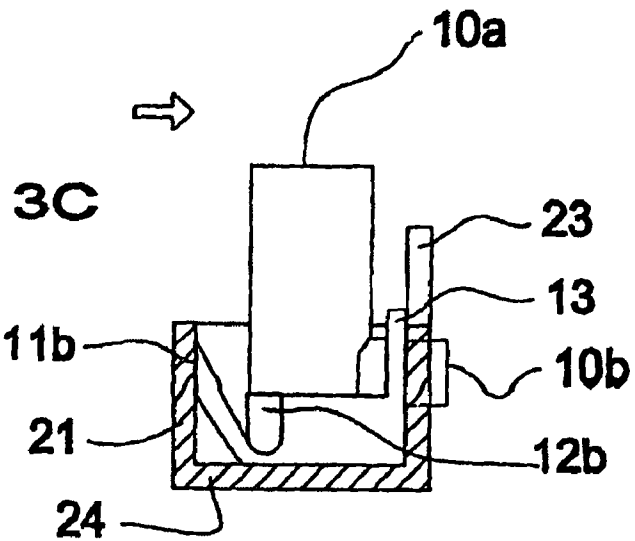

These return elements are able to retract such as to allow the insertion of the said system 1 in the said compartment 22, as shown in FIG. 3B, and then to rest against the back wall 23 so as to insert and maintain the downstream end 10*b* of the said conduit 10 through the said outlet orifice 20 as shown in FIG. 3C.

The system 1 is, in addition, provided with a stop plate 13, which supports the conduit 10. The profile of the plate 13 is adapted to the profile of the inner face of the front wall 23 of the compartment 22 against which the said plate rests at the end of the assembly process.

Figure 2:
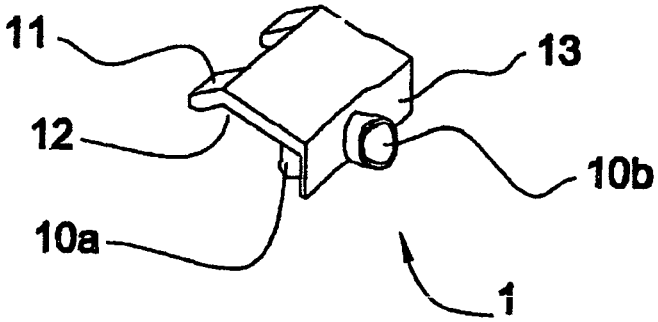
FIG. 2 shows a top perspective view of the embodiment of the invention shown in FIG. 1, after assembly.
Figure 2:
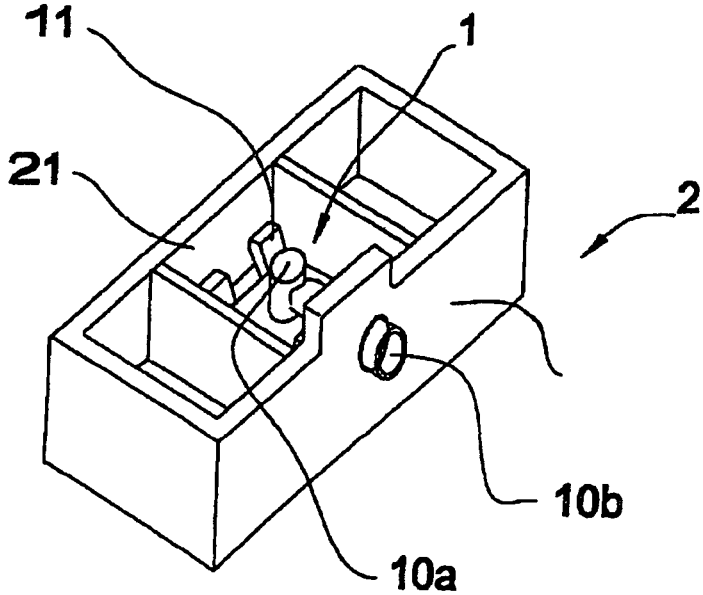

As shown in FIGS. 2 and 3C, the downstream end 10*b* of the conduit 10 preferably projects from the outside of the case 1.

The return elements 11 in this case consist of flexible tabs that have a guiding bottom face 11*a* and a flat end 11*b*.

These tabs are connected to the body of the dispensing system by means of fillets 12*a* forming hinges, which are delimited by cavities 12*b*.

In order to improve the wedging of the system in its locked position in the compartment 22, the support surface of the flat end 11*b* is enlarged.

Figure 3A:
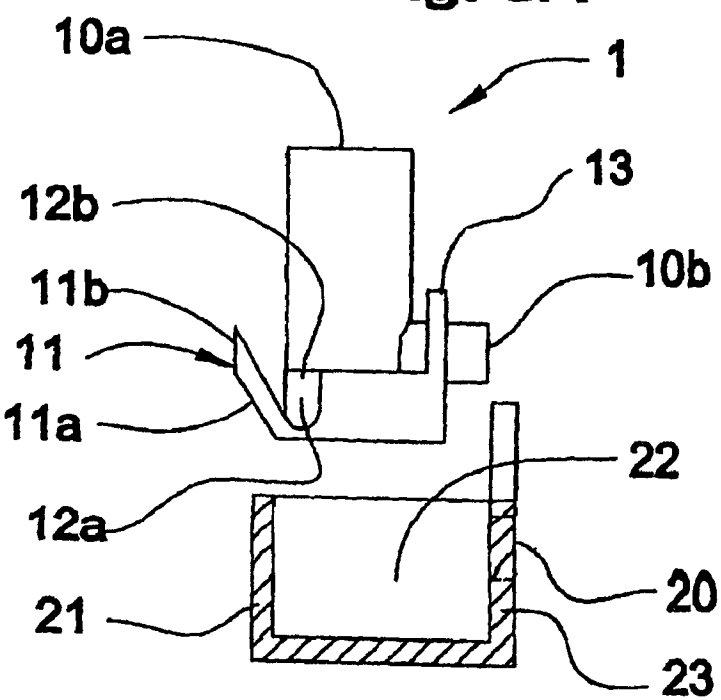

The face 11*a* is tilted in its relaxed position (FIG. 3A) in relation to the cross-section of the end 10*b* of the conduit 10. As suggested in FIGS. 3A and 3B, the face 11*a* initially rests against the top edge of the wall 21, and then due to vertical stress applied on the system 1 (see the arrow in FIG. 3B), the tabs 11 bend gradually inwards by distortion of the hinges 12*a* under the pressure, thanks to the cam effect of the tilted face 11*a* while the system 1 enters the compartment 20 of the case 2.

The movement continues in this way, the face 11*a* being in sliding contact with the inner face of the back wall 21, until the downstream end 10*b* of the conduit 10 which slides against the front wall 23, becomes aligned with the orifice 20. At this time, the tabs 11 are released and unfold, pushing the downstream end 10*b* into the orifice 10.

This step, which may produce a click, brings the plate 13 to stop against the front wall 23 and the flat ends 11*b* of the tabs 11 in stable resting contact against the back wall 21 as shown in FIG. 3C.

In this position it is provided for the tabs 11 to still be subjected to a slight pressure so as to avoid any possible play between the parts.

In the embodiment of the invention shown, the compartment 22 has a bottom 24 that connects the back 21 and front 23 walls and against which the system 1 rests at the end of the assembly process. The position of the bottom preferably corresponds to the alignment of the downstream end 10*b* of the conduit 10 with the axis of the outlet orifice 20, which makes it possible to obtain a correct position, particularly when the diameter of the orifice is greater than that of the conduit.

The removal of the system 1 from the compartment 22 is thus possible by pressing on the projecting end 10*b* and then simultaneously pulling on the upstream end 10*a* of the conduit 10.

What is claimed is:

1. A device for encasing a system for dispensing a liquid product, comprising:

an evacuation conduit comprising a downstream element having a downstream end that opens to the outside, the downstream element having a longitudinal axis and a cross-section that is generally perpendicular to the longitudinal axis;

a compartment respectively delimited by a back wall and a front wall, said back wall having a generally planar inner surface and said front wall having an outlet orifice formed therein; and at least one elastic return element supported by said system on the side opposite the downstream end that can retract such as to allow said system to be inserted in said compartment and can then rest against the back wall so as to insert and maintain the downstream end of said conduit in said outlet orifice;

wherein said elastic return element is made up of at least one flexible tab that has a guiding bottom face, tilted in its relaxed position in relation to the cross-section of the downstream element of said conduit which comes into sliding contact with the back wall when the dispensing system is inserted; and wherein said tab has a generally planar flat end that is generally parallel to the cross-section of the downstream element of said conduit, that comes into stable resting contact with the back wall, and that is generally coplanar with said generally planar inner surface of said back wall, when the downstream end of the conduit is inserted in the outlet orifice, such that forces between the generally planar flat end of said tab and said generally planar inner surface of said back wall force the downstream end of the conduit toward said front wall.

2. A device according to claim 1, further comprising: a stopping element made up of a plate supporting said conduit, the profile of which is adapted to the profile of the front wall against which said plate rests.

3. A device according to claim 1, wherein the downstream end of said conduit projects from the outside of the compartment.

4. A device according to claim 1 wherein said tab is connected to said system by means of a fillet forming a hinge.

5. A device according to claim 1, wherein said compartment comprises a bottom that connects the back and front walls.

6. A device according to claim 5, wherein said system rests against the bottom when the downstream end of the conduit is lined up with the outlet orifice.

7. A device according to claim 1, wherein said compartment is arranged in an external case forming a tappet-button.

8. A device according to claim 1, comprising two elastic return means disposed on either side of said conduit.

9. A device for encasing a system for dispensing a liquid product, comprising:

an evacuation conduit comprising a downstream element having a downstream end that opens to the outside, the downstream element having a longitudinal axis and a cross-section that is generally perpendicular to the longitudinal axis;

a compartment respectively delimited by a back wall and a front wall, said front wall having an outlet orifice formed therein; and at least one elastic return element supported by said system on the side opposite the downstream end that can retract such as to allow said system to be inserted in said compartment and can then rest against the back wall so as to insert and maintain the downstream end of said conduit in said outlet orifice;

wherein said elastic return element is made up of at least one flexible tab comprising a wall that is tilted in its relaxed position in relation to the cross-section of the down-stream element of said conduit, which wall includes a guiding bottom face that comes into sliding contact with the back wall when the dispensing system is inserted; and wherein said tab is connected to said system by means of a fillet forming a hinge, and has a generally planar flat end that is generally parallel to the cross-section of the downstream element of said conduit, that comes into stable resting contact with the back wall.

10. A device according to claim 9, further comprising: a stopping element made up of a plate supporting said conduit, the profile of which is adapted to the profile of the front wall against which said plate rests.

11. A device according to claim 9, wherein the downstream end of said conduit projects from the outside of the compartment.

12. A device according to claim 9 wherein said back wall has a generally planar inner surface and wherein said tab has a generally planar flat end that is generally parallel to the cross-section of the downstream element of said conduit, that comes into stable resting contact with the back wall, and that is generally coplanar with said generally planar inner surface of said back wall, when the downstream end of the conduit is inserted in the outlet orifice.

13. A device according to claim 9, wherein said compartment comprises a bottom that connects the back and front walls.

14. A device according to claim 13, wherein said system rests against the bottom when the downstream end of the conduit is lined up with the outlet orifice.

15. A device according to claim 9, wherein said compartment is arranged in an external case forming a tappet-button.

16. A device according to claim 9, comprising two elastic return means disposed on either side of said conduit.

* * * * *